US006196954B1

(12) United States Patent
Chen

(10) Patent No.: US 6,196,954 B1
(45) Date of Patent: Mar. 6, 2001

(54) SLIDING EXERCISER

(76) Inventor: Wu Tsung Chen, 7, Lane 279, Hsi Men Road, Sec 1, Tainan (TW)

( * ) Notice: Subject to any disclaimer, the term of this patent is extended or adjusted under 35 U.S.C. 154(b) by 0 days.

(21) Appl. No.: 09/493,292

(22) Filed: Jan. 28, 2000

(30) Foreign Application Priority Data

Feb. 4, 1999 (TW) ..... 088201851
Jun. 29, 1999 (TW) ..... 088201851A01

(51) Int. Cl.[7] ..... A63B 21/00
(52) U.S. Cl. ..... 482/131; 482/140; D21/676
(58) Field of Search ..... 482/19, 70, 140, 482/908, 121, 122, 95, 96, 126, 131, 130, 114; D21/676, 687, 673, 674

(56) References Cited

U.S. PATENT DOCUMENTS

D. 397,745 * 9/1998 Wu ..... D21/192
D. 425,585 * 5/2000 Wu ..... D21/676
3,589,720 * 6/1971 Agamian ..... 482/140
5,429,567 * 7/1995 Gerschefske et al. ..... 482/70
5,518,483 * 5/1996 Oswald ..... 482/131
5,582,565 * 12/1996 Soria ..... 482/908
6,071,217 * 6/2000 Barnett ..... 482/121

* cited by examiner

*Primary Examiner*—Stephen R. Crow
(74) *Attorney, Agent, or Firm*—Pro-Techtor International Services

(57) ABSTRACT

A sliding exerciser includes a track body, the track body having a base, a transverse bar, and rail means connected between the base and the transverse bar and smoothly upwardly curved from the transverse bar toward the base, a knee board connected to the transverse bar at a front side, and a slide coupled to the track body and reciprocated by the user along the rail means between the base and the transverse bar when the user kneeled down on the knee board, the slide having pairs of rollers bilaterally mounted on the inside and respectively coupled to the rail means.

3 Claims, 8 Drawing Sheets

SLIDING EXERCISER

BACKGROUND OF THE INVENTION

The present invention relates to a physical exercising apparatus, and more specifically to a sliding exerciser, which comprises a track body, and a slide supported on the track body and reciprocated by the user with the hands when the user kneeled down on a kneeboard in front of the track body.

A variety of physical exercising apparatus including rowing machines, body-bending machines, step exercisers, stationary bicycles, etc., have been disclosed, and have appeared on the market. These exercising apparatus are designed for exercising the muscles of different part of the body. There is known an exercising apparatus specifically designed for exercising the muscles of the abdomen. This exercising apparatus comprises a straight track, and a wheel slidably coupled to the track. The wheel has a wheel shaft extended out of two opposite sides thereof for the holding of the hands. When in use, the wheel is moved back and forth with the hands along the track. The wheel can easily be moved forwards with the hands. However, it requires much effort to pull back the wheel. After a forward stroke, the user may be unable to pull the wheel back.

SUMMARY OF THE INVENTION

The present invention provides a sliding exerciser, which is practical in use for exercising the muscles of the abdomen effectively. According to one aspect of the present invention, the sliding exerciser comprises a track body, the track body having a base, a transverse bar, and rail means connected between the base and the transverse bar, a knee board connected to the transverse bar at a front side, and a slide coupled to the track body and reciprocated by the user along the rail means between the base and the transverse bar when the user kneeled down on the knee board, the slide having pairs of rollers bilaterally mounted on the inside and respectively coupled to the rail means. According to another aspect of the present invention, the rail means is smoothly upwardly curved from the transverse bar toward the base. According to still another aspect of the present invention, the slide has holder means at the topside thereof for holding weights.

DETAILED DESCRIPTION OF THE PREFERRED EMBODIMENT

Figure 1:
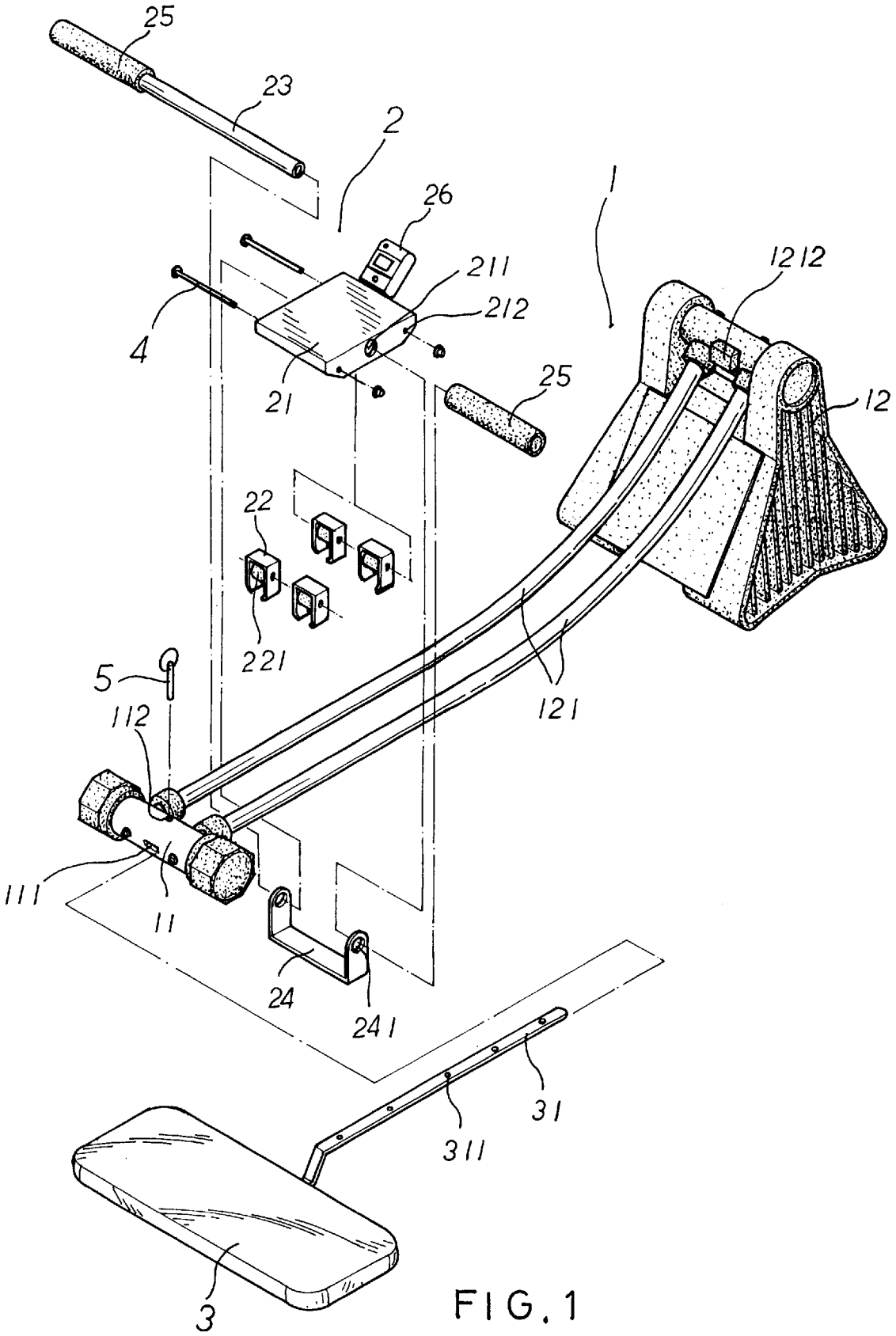
FIG. 1 is an exploded view of a sliding exerciser according to a first embodiment of the present invention.
Figure 2:
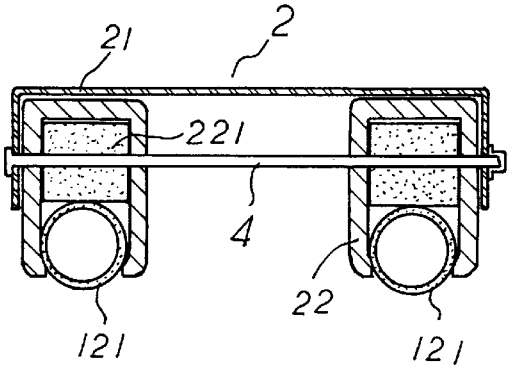
FIG. 2 is a cross-sectional view in an enlarged scale of the slide for the sliding exerciser shown in FIG. 1.
Figure 3:
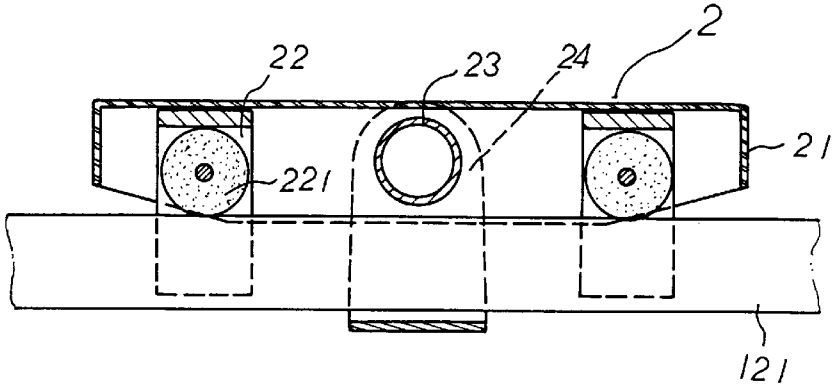
FIG. 3 is a sectional side view in an enlarged scale of a part of the sliding exerciser shown in FIG. 1, showing the slide coupled to the rails.
Figure 4:
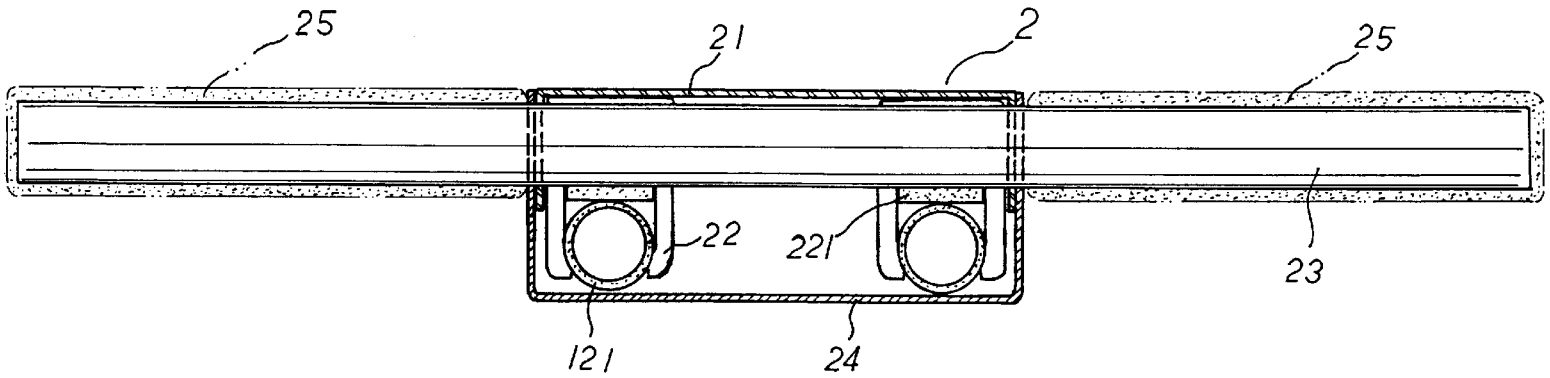
FIG. 4 is another cross-sectional view in an enlarged scale of the side for the sliding exerciser shown in FIG. 1, showing the positioning of handlebar in the slide body.
Figure 5:
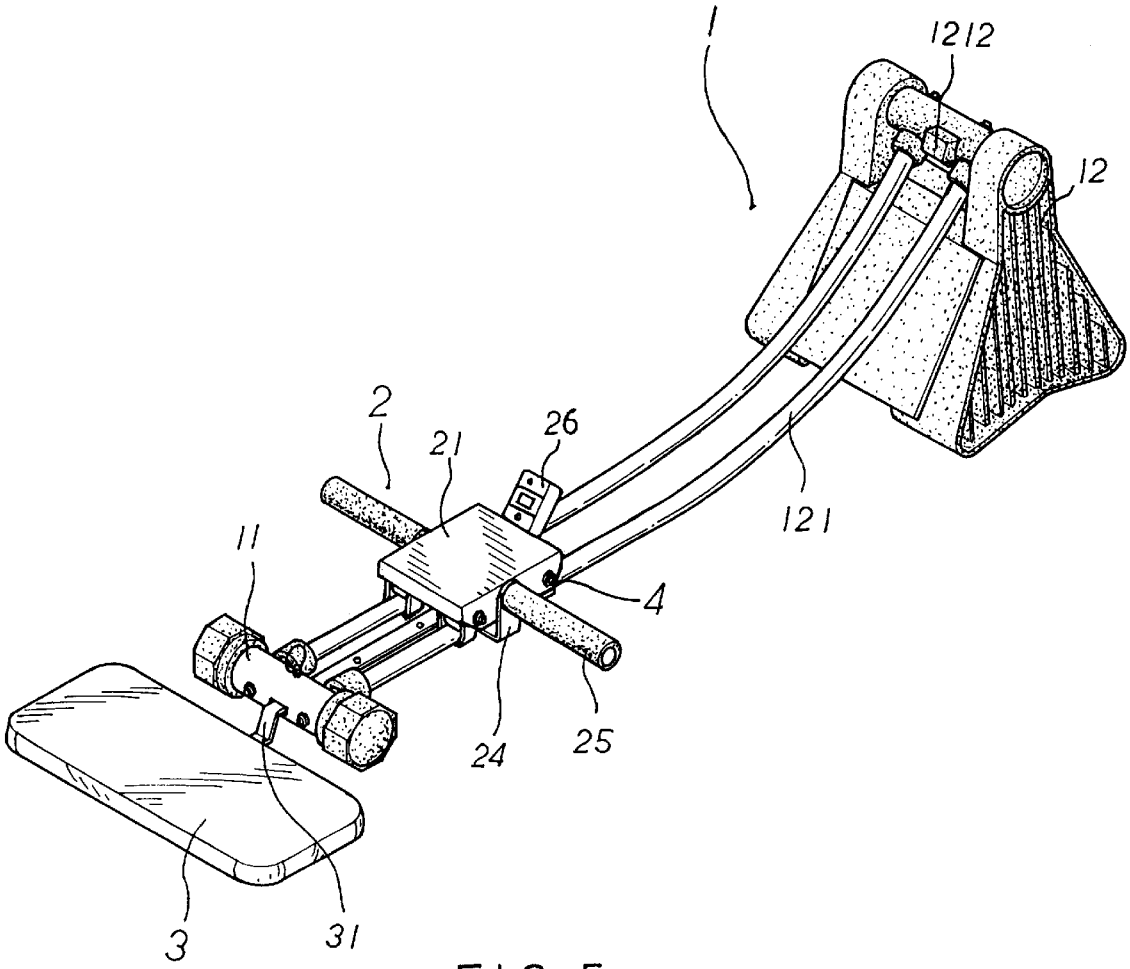
FIG. 5 is a perspective assembly view of the sliding exerciser shown in FIG. 1.

Referring to FIGS. from 1 through 5, a sliding exerciser in accordance with the present invention is generally comprised of a track body 1, a slide 2, and a kneeboard 3. The track body 1 comprises a transverse bar 11, a base 12, and two rails 121 connected in parallel between the transverse bar 11 and the base 12. The transverse bar 11 comprises a horizontally extended rectangular through hole 111, and a vertically extended through hole 112 across the rectangular through hole 111. The rails 121 each having one end connected to the transverse bar 11 and an opposite end smoothly curved upwards and connected to the base 12, i.e., the rails 121 slope downwards from the base 12 toward the transverse bar 11. The slide 2 is comprised of a slide body 21, two pairs of roller holders 22, a U-frame 24, and a handlebar 23. The slide body 21 is moved above the rails 121, having a U-shaped cross section, two through holes 211 aligned on two opposite vertical side walls thereof on the middle, and two pairs of axle holes 212 respectively aligned on the two opposite vertical side walls and respectively spaced from the through holes 211 at two opposite sides. The roller holders 22 each hold a roller 221. The U-frame 24 comprises two mounting holes 241 respectively disposed on two opposite ends thereof. The handlebar 23 is inserted through the mounting holes 241 on the U-frame 24 and the through holes 211 on the slide body 21 to secure the slide body 2 and the U-frame 24 together, enabling the rails 121, keeping the slide body 21 and the U-frame 24 to be respectively disposed at above and below the rails 121. Two pivot shafts 4 are respectively installed in the axle holes 212 to secure the roller holders 22 to the slide body 21 at the bottom side, keeping the rollers 221 of the roller holders 22 disposed in close contact with the rails 121 respectively. Further, two hand grips 25 are respectively mounted on two opposite ends of the handlebar 23, and disposed at two opposite sides of the slide body 21. The kneeboard 3 comprises a front locating bar 31 inserted through the rectangular through hole 111 on the transverse bar 11, having a plurality of longitudinally spaced locating holes 311. A lock pin 5 is inserted through the vertical through hole 112 on the transverse bar 11 into one locating hole 311 on the front locating bar 31 to lock the kneeboard 3. By shifting the lock pin 5 from one locating hole 311 on the front locating bar 31 to another, the pitch between the kneeboard 3 and the transverse bar 11 is adjusted.

Figure 6:
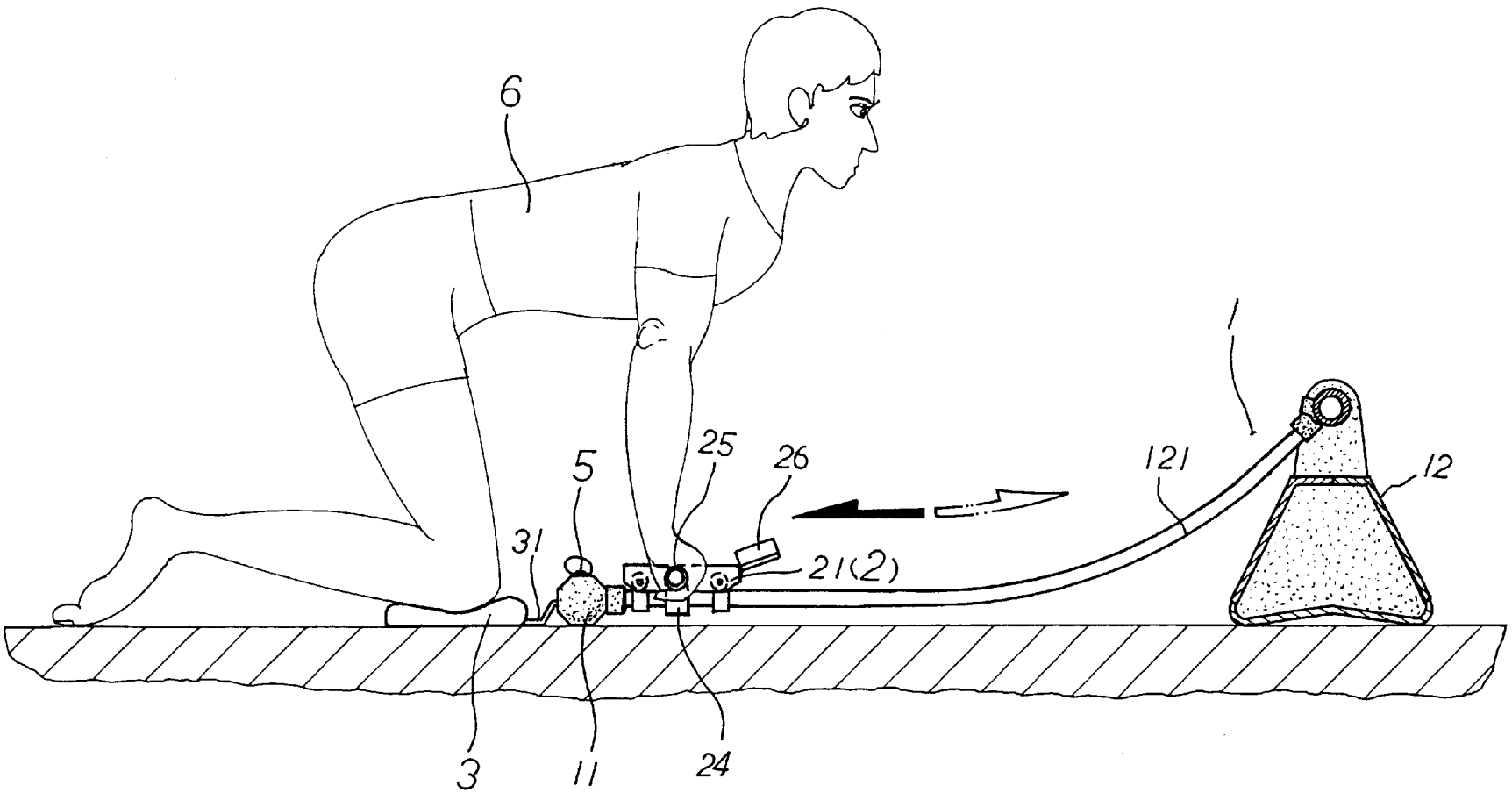
FIG. 6 is a schematic drawing showing an application example of the sliding exerciser according to the present invention.
Figure 7:
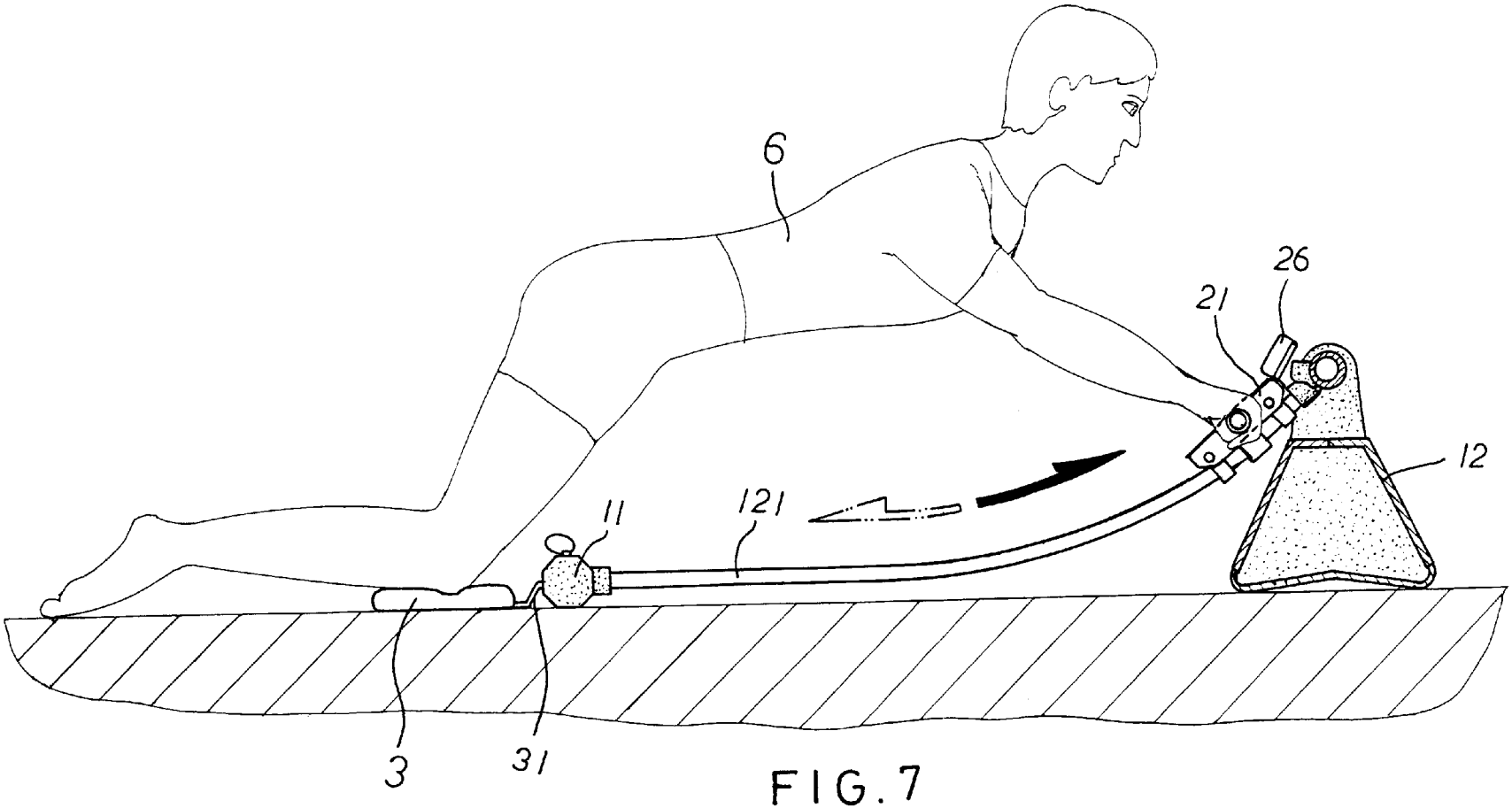
FIG. 7 is similar to FIG. 6 but showing the slide moved to the base of the track body.
Figure 8:
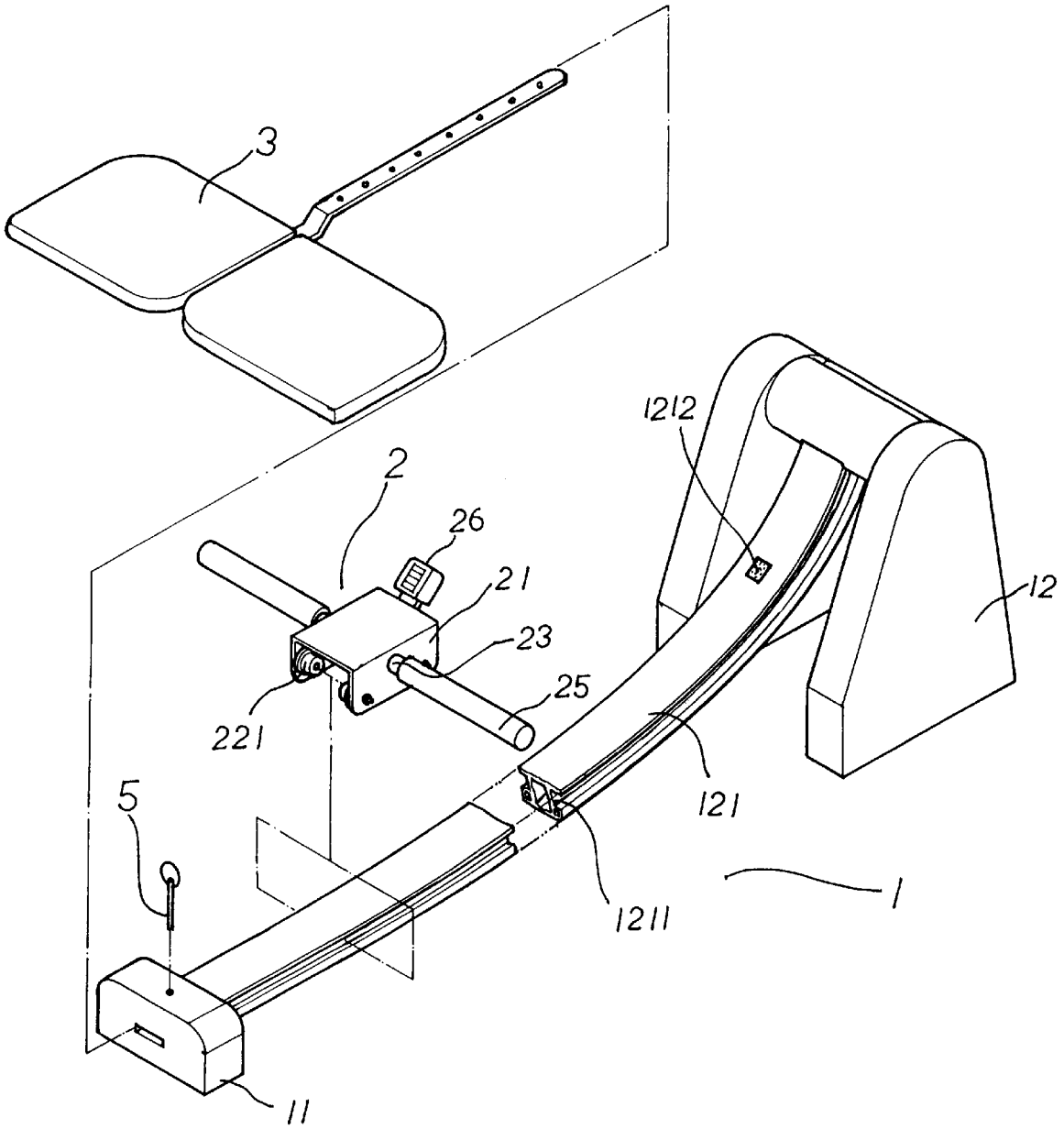
FIG. 8 is an exploded view of a sliding exerciser according to a second embodiment of the present invention.
Figure 9:
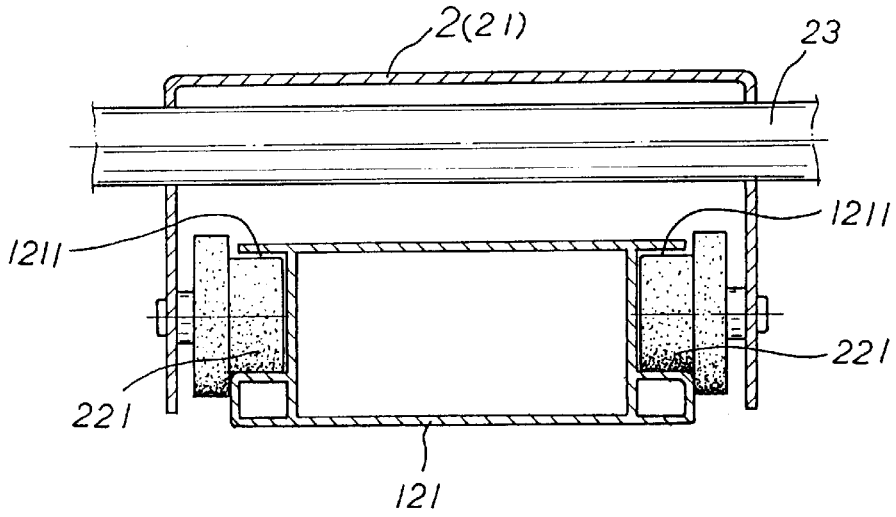
FIG. 9 is a cross-sectional view in an enlarged scale of the slide for the sliding exerciser shown in FIG. 8.
Figure 10:
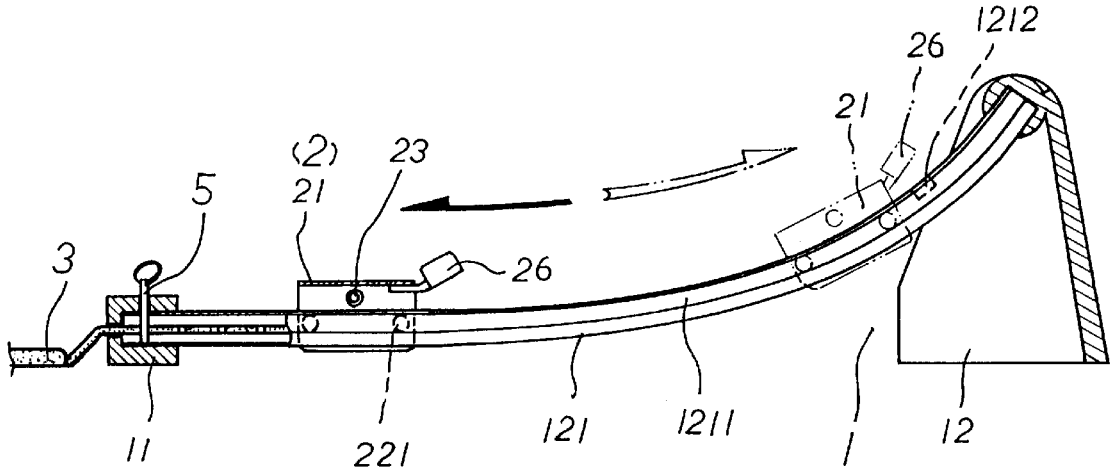
FIG. 10 is a schematic drawing showing the operation of the sliding exerciser according to the second embodiment of the present invention.

Referring to FIGS. 6 and 7, when in use, the position of the kneeboard 3 relative to the transverse bar 11 is adjusted. After adjustment of the position of the kneeboard 3, the user 6 can then operate the sliding exerciser by resting the knees on the kneeboard 6 and moving the slide 2 with the hands along the rails 121. The muscles of the users' arms, shoulders, abdomen and back are well exercised when the user 6 moves the slide 2 back and forth along the rails 121. Furthermore, a sensor 1212 is provided at the base 12 of the track body 1 between the rails 121, and a counter 26 is provided at the slide body 21 of the slide 2. The counter 26 acts with the sensor 1212 to count the number of times of the reciprocating movement of the slide 2 on the rails 121 by the user 6.

FIGS. from 8 through 10 show an alternate form of the present invention. This alternate form is comprised of a track body 1, a slide 2 moved on the track body 1, and a kneeboard 3 adjustably connected to the transverse bar 11 by a lock pin 5. The track body 1 comprises a transverse bar 11, a base 12, and a rail 121 connected between the transverse bar 11 and the base 12. The rail 121 comprises two longitudinal sliding grooves 1211 at two opposite sides. The slide 2 comprises a slide body 21, a handlebar 23 fastened to the slide body 21 and extended out of two opposite lateral side walls of the slide body 21, two hand grips 25 respectively fastened to the two distal ends of the handlebar 23 and disposed at two opposite sides of the slide body 21, and two pairs of rollers 221 respectively mounted inside the slide body 21 and coupled to the longitudinal sliding grooves 1211 to support the slide 2 on the rail 121, enabling the slide 2 to be reciprocated along the rail 121. This alternate form also comprises a sensor 1212 and a counter 26 for counting the number of times of the reciprocating movement of the slide 2 on the rail 121.

Figure 11:
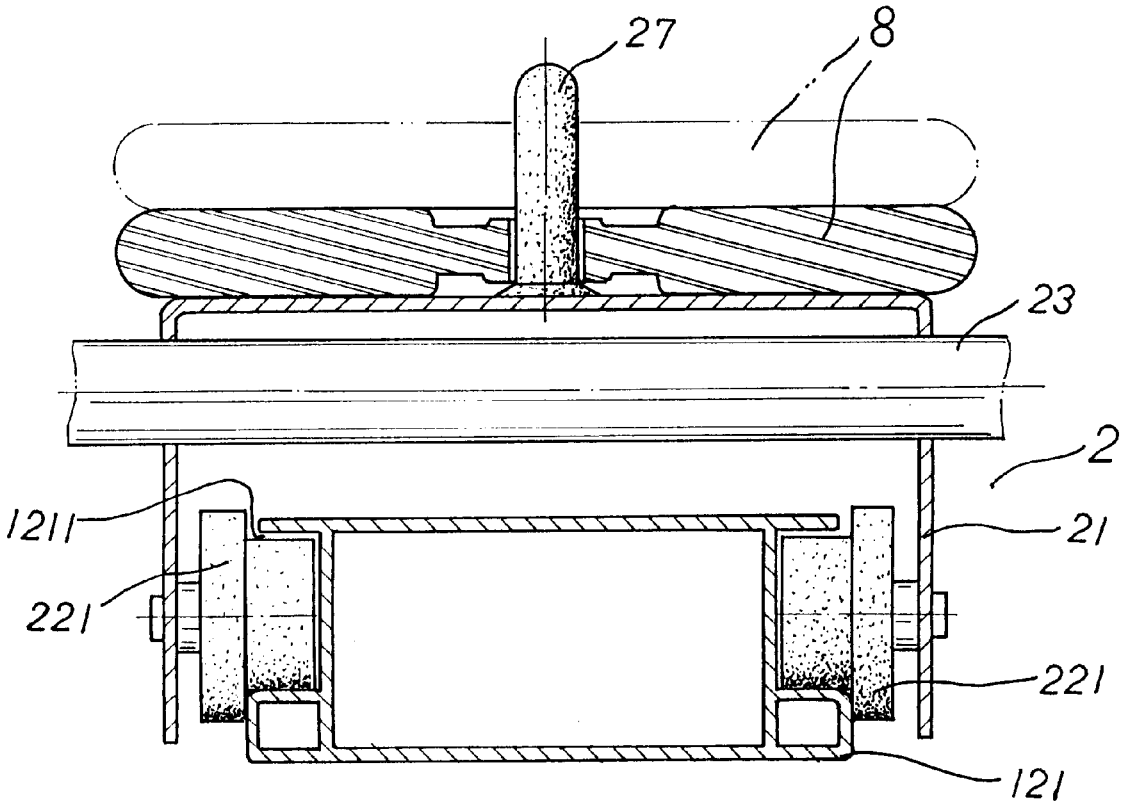
FIG. 11 is a cross sectional view of an alternate form of the slide according to the present invention, showing weights mounted on the upright rod at the top side of the slide body.

Referring to FIG. 11, holder means, for example, an upright rod 27 may be provided at the topside of the slide body 21 for holding weights 8. The user can adjust the number of weights 8 to receive different damping force.

It is to be understood that the drawings are designed for purposes of illustration only, and are not intended for use as a definition of the limits and scope of the invention disclosed. For example, the kneeboard 3 may be eliminated, or fixedly fastened to the transverse bar 11.

What the invention claimed is:

1. A sliding exerciser comprising:

a track body, said track body comprising a base, a transverse bar, and rail means connected between said transverse bar and said base and upwardly curved from said transverse bar toward said base, a slide coupled to said track body and moved along said rail means between said base and said transverse bar, said slide comprising a slide body and at least one pair of rollers bilaterally mounted inside said slide body and respectively coupled to said rail means for enabling said slide to be moved back and forth along said rail means, and a knee board coupled to said transverse bar at a front side, said knee board comprises a front locating bar fastened to said transverse bar of said track body; wherein said transverse bar of said track body comprises a horizontally extended rectangular through hole which receives said front locating bar of said knee board, and a vertical through hole across said horizontally extended rectangular through hole, said front locating bar of said knee board is inserted through the rectangular through hole on said transverse bar, said front locating bar having a plurality of longitudinally spaced locating holes selectively connected to said vertical through hole on said transverse bar of said track body by a lock pin.

2. The sliding exerciser of claim 1 further comprising a sensor mounted on said track body near one end of said rail means, and a counter mounted on said slide body driven by said sensor to count each time said slide body is moved toward said base of said track body to touch said sensor.

3. The sliding exerciser of claim 1 wherein said slide body comprises holder means for holding weights.

* * * * *